US009707593B2

(12) United States Patent
Berte

(10) Patent No.: US 9,707,593 B2
(45) Date of Patent: Jul. 18, 2017

(54) ULTRASONIC TRANSDUCER

(71) Applicant: uBeam Inc., New York, NY (US)

(72) Inventor: Marc Berte, Ashburn, VA (US)

(73) Assignee: uBeam Inc., Santa Monica, CA (US)

( * ) Notice: Subject to any disclaimer, the term of this patent is extended or adjusted under 35 U.S.C. 154(b) by 413 days.

(21) Appl. No.: 13/832,393

(22) Filed: Mar. 15, 2013

(65) Prior Publication Data

US 2014/0265727 A1 Sep. 18, 2014

(51) Int. Cl.
*B06B 1/06* (2006.01)
*G10K 9/122* (2006.01)

(52) U.S. Cl.
CPC ..... *B06B 1/0603* (2013.01); *G10K 9/122* (2013.01)

(58) Field of Classification Search
CPC ... H01L 41/04; H01L 41/053; H01L 41/0926; H01L 41/094
USPC ..... 310/330–332, 338, 344
See application file for complete search history.

(56) References Cited

U.S. PATENT DOCUMENTS

| | | | | |
|---|---|---|---|---|
| 3,946,831 A | | 3/1976 | Bouyoucos | |
| 5,198,716 A | | 3/1993 | Godshall et al. | |
| 5,376,221 A | | 12/1994 | Staudte | |
| 5,436,523 A | | 7/1995 | Staudte | |
| 5,517,291 A | | 5/1996 | Montfort et al. | |
| 6,003,390 A | * | 12/1999 | Cousy | 310/339 |
| 6,037,704 A | | 3/2000 | Welle | |
| 6,127,942 A | | 10/2000 | Welle | |
| 6,479,890 B1 | * | 11/2002 | Trieu et al. | 257/678 |
| 6,798,716 B1 | | 9/2004 | Charych | |
| 6,987,348 B2 | | 1/2006 | Buhler et al. | |
| 7,446,456 B2 | * | 11/2008 | Maruyama et al. | 310/328 |
| 7,489,967 B2 | | 2/2009 | Von Arx et al. | |
| 7,490,519 B2 | | 2/2009 | Subramanian et al. | |
| 7,606,621 B2 | | 10/2009 | Brisken et al. | |
| 7,610,092 B2 | | 10/2009 | Cowan et al. | |
| 7,710,002 B2 | * | 5/2010 | Horie et al. | 310/348 |

(Continued)

FOREIGN PATENT DOCUMENTS

| | | |
|---|---|---|
| CN | 102184729 A | 9/2011 |
| EP | 1423685 B1 | 8/2011 |

(Continued)

OTHER PUBLICATIONS

Bao et al.,"High-power piezoelectric acoustic-electric power feedthru for metal walls", Proceedings of SPIE, vol. 6930, pp. 1-8, 2008.

(Continued)

*Primary Examiner* — Derek Rosenau
(74) *Attorney, Agent, or Firm* — Morris & Kamlay LLP

(57) ABSTRACT

An ultrasonic transducer having a membrane and a container having a base and at least one wall element. The one or more wall elements can be situated over at least part of the base to form a cavity that can have an at least partially open end. The open end can be sealed with the membrane and the interior of the container can be maintained at a lower atmospheric pressure than the ambient pressure. Within the container, a piezoelectric flexure can be fixed at one end to a location at a wall element. The other end of the flexure can be in mechanical communication with the membrane, either directly or through a stiffener that is itself in communication with the membrane.

10 Claims, 3 Drawing Sheets

(56) References Cited

U.S. PATENT DOCUMENTS

| | | | |
|---|---|---|---|
| 7,902,943 | B2 | 3/2011 | Sherrit et al. |
| 7,992,271 | B2 | 8/2011 | Mehta |
| 8,082,041 | B1 | 12/2011 | Radziemski |
| 8,159,364 | B2 | 4/2012 | Zeine |
| 8,638,022 | B2 | 1/2014 | Komine et al. |
| 8,649,875 | B2 | 2/2014 | Sarvazyan |
| 8,816,567 | B2 | 8/2014 | Zuo et al. |
| 2001/0035700 | A1 | 11/2001 | Percin et al. |
| 2003/0020376 | A1 | 1/2003 | Sakaguchi et al. |
| 2004/0066708 | A1 | 4/2004 | Ogawa |
| 2004/0172083 | A1 | 9/2004 | Penner |
| 2004/0204744 | A1 | 10/2004 | Penner et al. |
| 2005/0070962 | A1 | 3/2005 | Echt et al. |
| 2005/0200243 | A1 | 9/2005 | Spangler et al. |
| 2005/0207589 | A1 | 9/2005 | Biegelsen |
| 2007/0109121 | A1 | 5/2007 | Cohen |
| 2007/0150019 | A1 | 6/2007 | Youker et al. |
| 2008/0184549 | A1 | 8/2008 | Nguyen-Dinh et al. |
| 2008/0309452 | A1 | 12/2008 | Zeine |
| 2010/0027379 | A1 | 2/2010 | Saulnier et al. |
| 2010/0157019 | A1 | 6/2010 | Schwotzer et al. |
| 2010/0164433 | A1 | 7/2010 | Janefalkar et al. |
| 2010/0286744 | A1 | 11/2010 | Echt et al. |
| 2010/0315045 | A1 | 12/2010 | Zeine |
| 2012/0193999 | A1 | 8/2012 | Zeine |
| 2012/0299540 | A1 | 11/2012 | Perry |
| 2012/0299541 | A1 | 11/2012 | Perry |
| 2012/0299542 | A1 | 11/2012 | Perry |
| 2012/0300588 | A1 | 11/2012 | Perry |
| 2012/0300592 | A1 | 11/2012 | Perry |
| 2012/0300593 | A1 | 11/2012 | Perry |
| 2013/0069865 | A1 | 3/2013 | Hart et al. |
| 2013/0207604 | A1 | 8/2013 | Zeine |
| 2013/0239700 | A1 | 9/2013 | Benfield et al. |
| 2013/0241468 | A1 | 9/2013 | Moshfeghi |
| 2013/0249353 | A1 | 9/2013 | Naito et al. |
| 2013/0264663 | A1 | 10/2013 | Dehe et al. |
| 2013/0271088 | A1 | 10/2013 | Hwang et al. |
| 2014/0265727 | A1 | 9/2014 | Berte et al. |

FOREIGN PATENT DOCUMENTS

| | | | |
|---|---|---|---|
| GB | 2386028 | A | 9/2003 |
| JP | 07327299 | A | 12/1995 |
| JP | 2002118440 | A | 4/2002 |
| JP | 2007-306389 | | 11/2007 |
| JP | 2008244964 | A | 10/2008 |
| JP | 5435243 | | 12/2013 |
| KR | 10-2009-0118873 | | 12/2009 |
| WO | 00/21020 | | 4/2000 |
| WO | 2006/069215 | | 6/2006 |
| WO | 2012166583 | | 12/2012 |
| WO | 2013143630 | A1 | 10/2013 |

OTHER PUBLICATIONS

Bao et al.,"Wireless piezoelectric acoustic-electric power feedthru", Proceedings of SPIE, vol. 6529, pp. 1-7, 2007.

Etherington,"Cota by Ossia Aims to Drive a Wireless Power Revolution and Change How We Think About Charging", Available at: http://techcrunch.com/2013/09/09/cota-by-ossia-wireless-power/. Date visited: Sep. 12, 2013, pp. 1-4, Sep. 9, 2013.

MobilityWire,"Ossia Unveils World's First Commercially Viable Remote Wireless Power System", Available at: http://www.mobilitywire.com/ossia/2013/09/1017888. Date visited: Sep. 12, 2013, pp. 1-4, Sep. 10, 2013.

Sherrit et al.,"Comparison of the Mason and KLM Equivalent Circuits for Piezoelectric Resonators in the Thickness Mode", IEEE Ultrasonics Symposium, vol. 2, pp. 921-926, 1999.

Sherrit et al.,"Efficient Electromechanical Network Models for Wireless Acoustic-Electric Feed-throughs", Proceedings of the SPIE Smart Structures Conference, vol. 5758, pp. 362-372, Mar. 6-10, 2005.

Sherrit et al.,"Solid Micro Horn Array (SMIHA) for Acoustic Matching", Proceedings of SPIE, vol. 6932, pp. 1-9, 2008.

Sherrit et al.,"Studies of Acoustic-Electric Feed-throughs for Power Transmission Through Structures", Proceedings of SPIE, vol. 6171, pp. 1-8, 2006.

Sherrit,"The Physical Acoustics of Energy Harvesting", IEEE International Ultrasonics Symposium Proceedings, pp. 1046-1055, 2008.

Invitation to Pay Additional Fees and Partial International Search Report for PCT/US2014/028133 mailed Jul. 18, 2014.

Intellectual Ventures,"MSA-T", Available at: http://www.intellectualventures.com/index.php/inventions-patents/our-inventions/msa-t. Date visited: Mar. 21, 2013., 2013.

Intellectual Ventures,"MSA-T: Enabling affordable, all-electronic beam steering satcom user terminals", Available at: http://www.intellectualventures.com/assets_docs/IV_metamaterials_technical_overview.pdf. Visited on: Mar. 21, 2013, 2011.

Germano,"Flexure Mode Piezoelectric Transducers", Morgan Electro Ceramics, Technical Publication TP-218. J. Acoust. Soc. Am. vol. 50, Issue 1A, pp. 1-6, 1971.

International Search Report in International Application No. PCT/US2012/039536, mailed Aug. 14, 2012.

Morgan Electro Ceramics,"Cantilever Mounted PZT 5A Bimorphs", Technical Publication TP-245, pp. 1-8, 1999.

Jiang, et al., "Multi-Channel Indoor Wireless Data Communication Using High-k Capacitive Ultrasonic Transducers in Air", Ultrasonics Symposium (IUS), 2013 IEEE International, Jul. 2013, Prague pp. 1606-1609, ISSN: 1948-5719.

Murray, Susan L., et al., "Effect of mesa-shaping on spurious modes in ZnO/Si bulk-wave composite resonators", Institute of Electrical and Electronics Engineers, 1983, 498-503.

Nam-Trung Nguyen, et al., "Acoustic streaming in micromachined flexural plate wave devices: numerical simulation and experimental verification", IEEE Transactions on Ultrasonics, Ferroelectrics, and Frequency Control (vol. 47, Issue: 6), Nov. 2000, 1463-1471.

S Tadigadapa, et al., "Piezoelectric MEMS sensors: state-of-the-art and perspectives", Measurement Science and Technology vol. 20 No. 9 Meas. Sci. Technol. 20 092001 doi:10.1088/0957-0233/20/9/092001, 2009.

Soeren Hirsch, et al., "A new device with PZT ultrasonic transducers in MEMS technology", Journal of Physics: Conference Series vol. 34; J. Phys.: Conf. Ser. 34 475 doi:10.1088/1742-6596/34/1/078, 2006.

Takashi Abe, et al., "Inverted Mesa-Type Quartz Crystal Resonators Fabricated by Deep-Reactive Ion Etching", IEEE Transactions on Ultrasonics, Ferroelectrics, and Frequency Control, vol. 53, No. 7, Jul. 2006, 1234.

International Search Report and Written Opinion issued in PCT/US2015/064520 on Feb. 16, 2016.

* cited by examiner

ULTRASONIC TRANSDUCER

BACKGROUND

Ultrasonic transducers receive electrical energy as an input and provide acoustic energy at ultrasonic frequencies as an output. An ultrasonic transducer can be a piece of piezoelectric material that changes size in response to the application of an electric field. If the electric field is made to change at a rate comparable to ultrasonic frequencies, then the piezoelectric element can vibrate, causing it to generate acoustic pressure waves.

BRIEF SUMMARY

In an implementation, an ultrasonic transducer can include a membrane and a container having a base and at least one wall element. The one or more wall elements can be situated over at least part of the base to form a cavity that can have an at least partially open end. The open end can be sealed with the membrane and the interior of the container can be maintained at a lower atmospheric pressure than the ambient pressure. Within the container, a piezoelectric flexure can be fixed at one end to a location at a wall element. The other end of the flexure can be in mechanical communication with the membrane, either directly or through a stiffener that is itself in communication with the membrane.

The flexure can include a substrate, a piezoelectric material and an electrode. The piezoelectric material may be disposed in one or more layers as part of the flexure. The flexure may include one or more electrodes. In an embodiment of a flexure, a thin film piezoelectric material can be disposed between a substrate and a conductor. In another embodiment, a substrate may be surrounded on both sides by piezoelectric layers, which in turn can be at least partially covered by conductors.

The ultrasonic transducer can receive an electrical control signal, causing the flexure to vibrate at or around ultrasonic frequencies. The flexure can thereby cause the membrane to vibrate and create ultrasonic frequency acoustic waves.

Additional features, advantages, and implementations of the disclosed subject matter may be set forth or apparent from consideration of the following detailed description, drawings, and claims. Moreover, it is to be understood that both the foregoing summary and the following detailed description provide examples of implementations and are intended to provide further explanation without limiting the scope of the claims.

BRIEF DESCRIPTION OF THE DRAWINGS

The accompanying drawings, which are included to provide a further understanding of the disclosed subject matter, are incorporated in and constitute a part of this specification. The drawings also illustrate implementations of the disclosed subject matter and together with the detailed description serve to explain the principles of implementations of the disclosed subject matter. No attempt is made to show structural details in more detail than may be necessary for a fundamental understanding of the disclosed subject matter and various ways in which it may be practiced.

DETAILED DESCRIPTION

Figure 1:
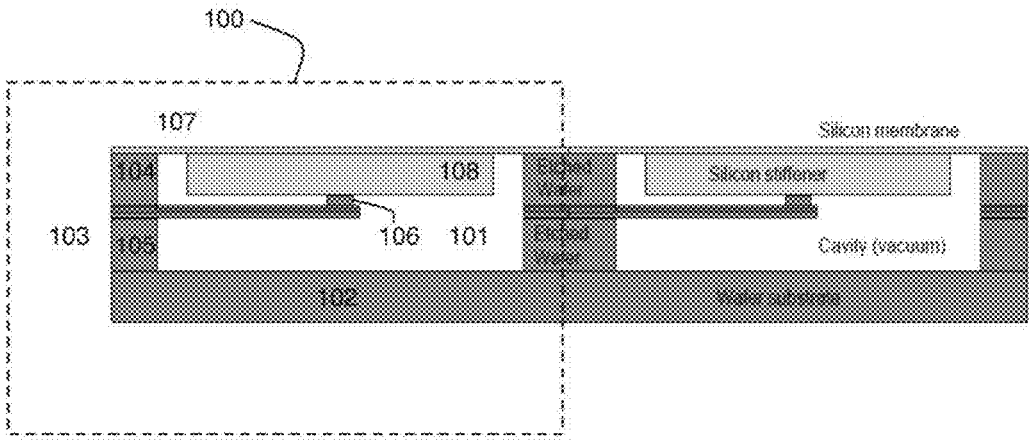
FIG. 1 shows an ultrasonic transducer according to an implementation of the disclosed subject matter.

According to the present disclosure, an ultrasonic transducer can include a piezoelectric flexure that can be mechanically fixed at one end to a location at a wall of a container and that can be in mechanical contact with a membrane at one end of the container. The piezoelectric flexure can be driven by an electrical control signal to displace the membrane at or around ultrasonic frequencies, thereby generating ultrasonic waves.

An embodiment of the ultrasonic transducer can include a membrane over a cavity. The membrane can be made of monocrystalline silicon, which can be resistant to fatigue. However, any other suitable material can be used for the membrane, including, for example, any material that can be formed into a thin layer, be resistant to fatigue, be naturally or through doping conductive, and be bondable to the other materials. Such materials include single-crystal materials such as Silicon Carbide, Silicon Nitride, Silica, Alumina, Diamond, and super-elastic metal alloys such as NiTi. The cavity can have at least one wall element situated over a base to form a container having an open end. The one or more wall elements over the base can form the container as a cylinder, a box, or any suitable shape. The open end of the container can be sealed with the membrane. The sealed container can be maintained at a lower atmospheric pressure than the ambient environment. This can pretension the membrane and improve its effectiveness as an ultrasonic vibrator. In various implementations, the interior of the container can be maintained at or about the ambient atmospheric pressure or at a pressure that is higher than the ambient pressure.

Embodiments of the transducer can include at least one piezoelectric flexure. Around one end of the flexure, the flexure can be fixed at a location at the at least one wall element. Around the other end of the flexure, the flexure can be in mechanical contact with the membrane. In an embodiment, the flexure may be in direct contact with the membrane itself. In another embodiment, the flexure can be in mechanical contact with a stiffener that can be disposed between the membrane and the flexure. One side of the stiffener can be in mechanical contact with the membrane and the other side of the stiffener can be in mechanical contact with the flexure. In this way, the stiffener can transmit mechanical vibration of the flexure to the membrane. The stiffener can be made of silicon, or any other suitable material, such as the materials listed above for the membrane. The stiffener need not be made of the same material as the membrane. The stiffener can improve the resonant properties of the transducer.

In embodiments, the piezoelectric flexure can include a substrate, a piezoelectric material and an electrode. The piezoelectric layer can be a thin film piezoelectric material or any other suitable piezoelectric material, such as PZT, PMN-PT, PVDF for example. The substrate can be made of a variety of materials including standard metals (brass, stainless steel, aluminum), composite materials (CFRP), or homogeneous polymer materials. The electrode can be made, for example, of screen printed or vapor deposited compatible conductive materials such as gold, platinum, alloys of those, along with other pure metals and alloys. The substrate, piezoelectric material and electrode can be configured in any suitable arrangement. For example, in an embodiment, the piezoelectric material can be disposed at least partly between the substrate and the electrode layer. In another embodiment, the substrate layer can be disposed between the electrode layer and the piezoelectric material. In yet another embodiment, the flexure can include a first electrode layer disposed over at least part of a first layer of piezoelectric material, which in turn can be disposed at least partly over the substrate material. The substrate material can be disposed at least partly over a second thin film piezoelectric material, which in turn can be disposed at least partly over a second electrode.

The at least one wall can include a wall element that includes two parts that can be electrically isolated from each other. One part of the wall element can be electrically connected to the electrode of the flexure and the second part can be electrically connected to the substrate. A control signal can be conveyed through one or both of the parts of the wall element to the flexure. In response, the flexure can cause the membrane to vibrate at ultrasonic frequencies, thereby creating ultrasonic frequency acoustic waves.

FIG. 1 shows an embodiment of the disclose subject matter that includes two ultrasonic transducers. The container 101 of one transducer 100 can be defined by base 102 and a wall element 103. The wall element 103 can have an upper part 104 and a lower part 105. The upper part 104 can be electrically connected to an electrode portion of a flexure 106. The lower part 105 can be electrically connected to a substrate of the flexure 106. The top of the container can be sealed by a membrane 107. A stiffener 108 can be provided in conjunction with the membrane 107. The flexure 106 can be in mechanical communication with the stiffener 108. A control signal can be fed to the upper part 104 and/or the lower part 105 of the wall element 103.

Figure 2:
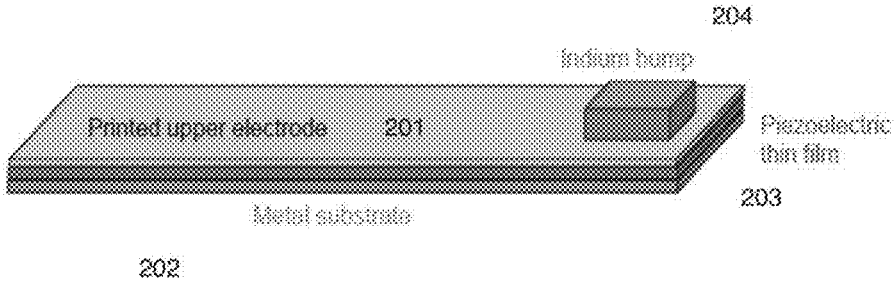
FIG. 2 shows a flexure according to an implementation of the disclosed subject matter.

FIG. 2 shows an embodiment of a flexure. The flexure includes an upper electrode 201 and a metal substrate 202 with a piezoelectric material 203 disposed therebetween. A bump 204 can be fixed toward one end of the flexure to facilitate the flexure's mechanical communication with the stiffener 108 and/or membrane 107.

Figure 3:
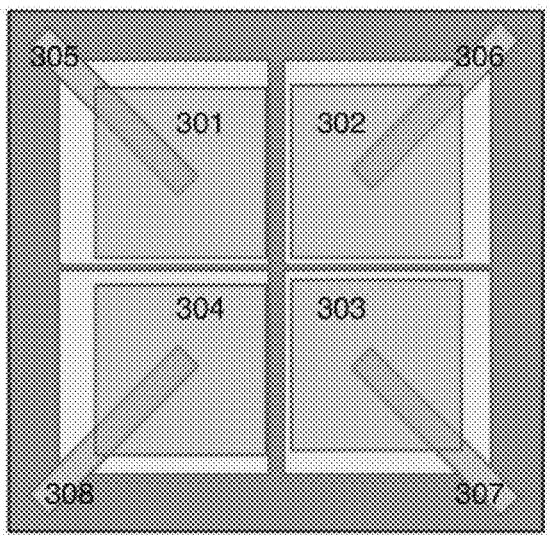
FIG. 3 shows an ultrasonic transducer configuration according to an implementation of the disclosed subject matter.

FIG. 3 shows the configuration of an embodiment of four transducers, 301, 302, 303 and 304. Flexures 305, 306, 307 and 308 extend from corners of the transducers. The flexures can be placed diagonally to increase their length. The tip displacement of a flexure can be a function of its length. Output acoustic pressure can be a function of diaphragm displacement. That is, the more the diaphragm moves, the more pressure can be created in the air. A design with increased flexure length can increase membrane motion, thereby generating more powerful ultrasonic acoustic waves.

In yet another embodiment, a single container can include more than one membrane. Each of the more than one membranes can be powered by a separate flexure. Such an arrangement could provide opportunities to have longer flexures. For example, a flexure could be fixed to a wall location and be in mechanical communication not necessarily with the closest membrane to the wall location, but with a membrane that is more distant from the wall location. The additional length could cause the flexure/membrane combination to generate more powerful ultrasonic acoustic waves. For example, in FIG. 3, the four transducers may be modified into a single container with four membranes, each membrane at a location 301, 302, 303 and 304. Flexure 305 can be in mechanical contact with membrane 303 rather than membrane 301, thereby lengthening flexure 305. The other flexures can be arranged similarly. A crossing point of one flexure with another can be managing by forming one flexure to pass underneath or over the other, thereby preventing them from interfering with each other in operation. The vacuum of the container can avoid acoustic interference within the single container between different flexures and membranes.

Figure 4:
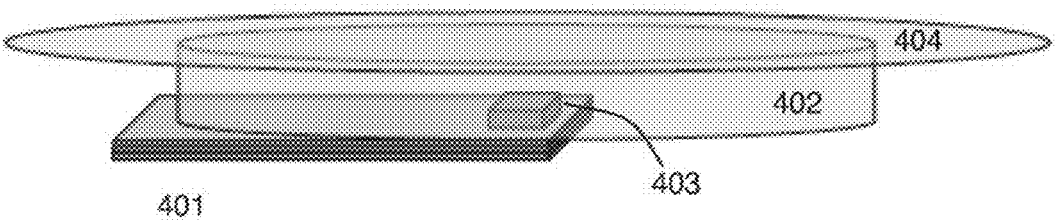
FIG. 4 shows a flexure in communication with a membrane according to an implementation of the disclosed subject matter.

FIG. 4 shows flexure 401 in mechanical communication with stiffener 402 through bump 403. Stiffener 401 is in mechanical communication with the membrane 404.

Figure 5:
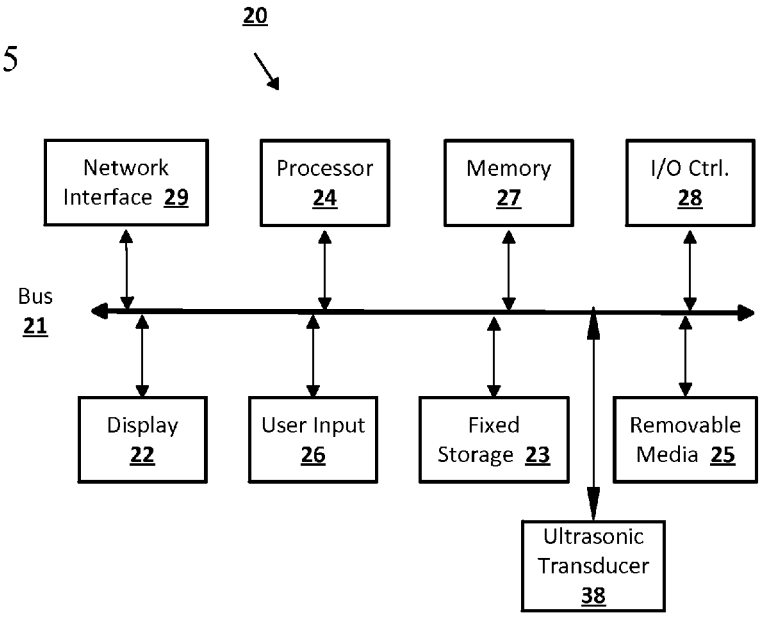
FIG. 5 shows a computer according to an implementation of the disclosed subject matter.

Implementations of the presently disclosed subject matter may be implemented in and used with a variety of component and network architectures. FIG. 5 is an example computer 20 suitable for implementations of the presently disclosed subject matter. The computer 20 includes a bus 21 which interconnects major components of the computer 20, such as a central processor 24, a memory 27 (typically RAM, but which may also include ROM, flash RAM, or the like), an input/output controller 28, a user display 22, such as a display screen via a display adapter, a user input interface 26, which may include one or more controllers and associated user input devices such as a keyboard, mouse, and the like, and may be closely coupled to the I/O controller 28, fixed storage 23, such as a hard drive, flash storage, Fibre Channel network, SAN device, SCSI device, and the like, and a removable media component 25 operative to control and receive an optical disk, flash drive, and the like.

The bus 21 allows data communication between the central processor 24 and the memory 27, which may include read-only memory (ROM) or flash memory (neither shown), and random access memory (RAM) (not shown), as previously noted. The RAM is generally the main memory into which the operating system and application programs are loaded. The ROM or flash memory can contain, among other code, the Basic Input-Output system (BIOS) that controls basic hardware operation such as the interaction with peripheral components. Applications resident with the computer 20 are generally stored on and accessed via a computer readable medium, such as a hard disk drive (e.g., fixed storage 23), an optical drive, floppy disk, or other storage medium 25. The bus 21 also allows communication between the central processor 24 and the ultrasonic transducer 38. For example, data can be transmitted from the processor 24 to a waveform generator subsystem (not shown) to form the control signal that can drive the ultrasonic transducer 38.

The fixed storage 23 may be integral with the computer 20 or may be separate and accessed through other interfaces. A network interface 29 may provide a direct connection to a remote server via a telephone link, to the Internet via an Internet service provider (ISP), or a direct connection to a remote server via a direct network link to the Internet via a POP (point of presence) or other technique. The network interface 29 may provide such connection using wireless techniques, including digital cellular telephone connection, Cellular Digital Packet Data (CDPD) connection, digital satellite data connection or the like. For example, the network interface 29 may allow the computer to communicate with other computers via one or more local, wide-area, or other networks, as shown in FIG. 6.

Many other devices or components (not shown) may be connected in a similar manner. Conversely, all of the components shown in FIG. 5 need not be present to practice the present disclosure. The components can be interconnected in different ways from that shown. The operation of a computer such as that shown in FIG. 5 is readily known in the art and is not discussed in detail in this application. Code to implement the present disclosure can be stored in computer-readable storage media such as one or more of the memory 27, fixed storage 23, removable media 25, or on a remote storage location. For example, such code can be used to provide the waveform and other aspects of the control signal that drives a flexure.

Figure 6:
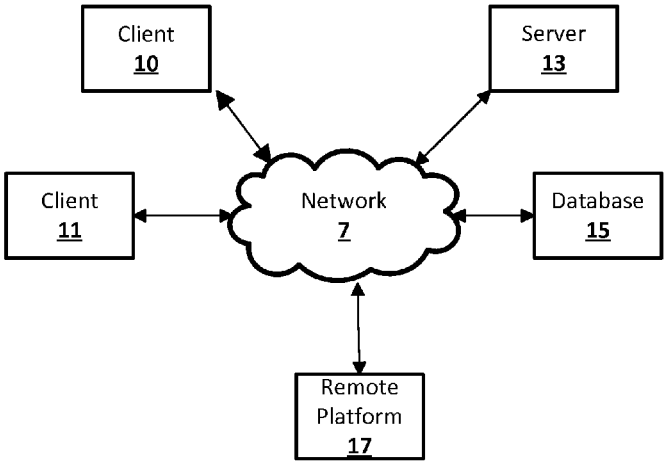
FIG. 6 shows a network configuration according to an implementation of the disclosed subject matter.

FIG. 6 shows an example network arrangement according to an implementation of the disclosed subject matter. One or more clients 10, 11, such as local computers, smart phones, tablet computing devices, and the like may connect to other devices via one or more networks 7. The network may be a local network, wide-area network, the Internet, or any other suitable communication network or networks, and may be implemented on any suitable platform including wired and/or wireless networks. The clients may communicate with one or more servers 13 and/or databases 15. The devices may be directly accessible by the clients 10, 11, or one or more other devices may provide intermediary access such as where a server 13 provides access to resources stored in a database 15. The clients 10, 11 also may access remote platforms 17 or services provided by remote platforms 17 such as cloud computing arrangements and services. The remote platform 17 may include one or more servers 13 and/or databases 15.

More generally, various implementations of the presently disclosed subject matter may include or be implemented in the form of computer-implemented processes and apparatuses for practicing those processes. Implementations also may be implemented in the form of a computer program product having computer program code containing instructions implemented in non-transitory and/or tangible media, such as floppy diskettes, CD-ROMs, hard drives, USB (universal serial bus) drives, or any other machine readable storage medium, wherein, when the computer program code is loaded into and executed by a computer, the computer becomes an apparatus for practicing implementations of the disclosed subject matter. Implementations also may be implemented in the form of computer program code, for example, whether stored in a storage medium, loaded into and/or executed by a computer, or transmitted over some transmission medium, such as over electrical wiring or cabling, through fiber optics, or via electromagnetic radiation, wherein when the computer program code is loaded into and executed by a computer, the computer becomes an apparatus for practicing implementations of the disclosed subject matter. When implemented on a general-purpose microprocessor, the computer program code segments configure the microprocessor to create specific logic circuits. In some configurations, a set of computer-readable instructions stored on a computer-readable storage medium may be implemented by a general-purpose processor, which may transform the general-purpose processor or a device containing the general-purpose processor into a special-purpose device configured to implement or carry out the instructions. Implementations may be implemented using hardware that may include a processor, such as a general purpose microprocessor and/or an Application Specific Integrated Circuit (ASIC) that implements all or part of the techniques according to implementations of the disclosed subject matter in hardware and/or firmware. The processor may be coupled to memory, such as RAM, ROM, flash memory, a hard disk or any other device capable of storing electronic information. The memory may store instructions adapted to be executed by the processor to perform the techniques according to implementations of the disclosed subject matter.

The foregoing description, for purpose of explanation, has been described with reference to specific implementations. However, the illustrative discussions above are not intended to be exhaustive or to limit implementations of the disclosed subject matter to the precise forms disclosed. Many modifications and variations are possible in view of the above teachings. The implementations were chosen and described in order to explain the principles of implementations of the disclosed subject matter and their practical applications, to thereby enable others skilled in the art to utilize those implementations as well as various implementations with various modifications as may be suited to the particular use contemplated.

The invention claimed is:

1. A device, comprising:

a membrane;

a container having a base and at least one wall element, the at least one wall element situated over at least part of the base to form a cavity having an least partially open end, the at least partially open end of the cavity substantially sealed with the membrane; and a piezoelectric flexure having a first end and a second end, the first end of the flexure fixed at a location at the at least one wall element, the second end of the flexure being free to move and in mechanical communication with the membrane, the piezoelectric flexure adapted to vibrate at ultrasonic frequencies and cause the membrane to create ultrasonic frequency acoustic waves wherein the membrane has an upper part and a lower part and further comprising a stiffener element having a first side and a second side, the first side of the stiffener fixed to at least a portion the lower part of the membrane and the second side of the stiffener fixed to the second end of the flexure.

2. The device of claim 1, wherein the membrane is monocrystalline silicon.

3. The device of claim 1, wherein the piezoelectric flexure comprises a substrate layer, an electrode layer and a piezoelectric material disposed at least partly between the substrate and the electrode layer.

4. The device of claim 1, wherein the piezoelectric flexure comprises a first electrode layer disposed over at least part of a first piezoelectric material disposed at least partly over a substrate material, disposed at least partly over a second piezoelectric material disposed at least partly over a second electrode.

5. The device of claim 1, wherein the piezoelectric material is a thin film piezoelectric material.

6. The device of claim 1, wherein the at least one wall element comprises a first part and a second part, the first part electrically connected to the electrode of the flexure and the second part electrically connected to the substrate of the flexure.

7. The device of claim 1, wherein the membrane is electrically connected to the electrode of the flexure.

8. The device of claim 1, further comprising a control signal source electrically connected to the electrode of the flexure.

9. The device of claim 6, further comprising a control signal source electrically connected to at least the first part of the wall element.

10. The device of claim 6, further comprising a control signal source electrically connected to at least the second part of the wall element.

* * * * *